United States Patent [19]

Franz et al.

[11] 4,364,296

[45] Dec. 21, 1982

[54] ELECTRICAL MUSICAL INSTRUMENT

[75] Inventors: Reinhard Franz, Tulpenstrasse 15, D-5401 Emmelshausen, Fed. Rep. of Germany; Wilfried Dittmar, Halsenbach, Fed. Rep. of Germany

[73] Assignee: Reinhard Franz, Emmelshausen, Fed. Rep. of Germany

[21] Appl. No.: 236,236

[22] Filed: Feb. 20, 1981

[30] Foreign Application Priority Data

Feb. 21, 1980 [DE] Fed. Rep. of Germany ..... 3006453

[51] Int. Cl.[3] ..... G10H 1/02

[52] U.S. Cl. ..... 84/1.26; 84/1.1; 84/1.24

[58] Field of Search ..... 84/1.1, 1.19, DIG. 8, 84/1.24, 1.01, 1.13, 1.26, DIG. 4

[56] References Cited

U.S. PATENT DOCUMENTS

| | | | |
|---|---|---|---|
| 3,636,231 | 1/1972 | Schrecongost et al. | 84/1.19 |
| 3,828,109 | 8/1974 | Morez | 84/1.24 |
| 3,935,783 | 2/1976 | Machanian et al. | 84/1.1 |
| 4,206,674 | 6/1980 | Bagus et al. | 84/DIG. 8 |

FOREIGN PATENT DOCUMENTS

| | | |
|---|---|---|
| 2509684 | 9/1976 | Fed. Rep. of Germany . |
| 2709532 | 8/1977 | Fed. Rep. of Germany . |

*Primary Examiner*—J. V. Truhe
*Assistant Examiner*—Forester W. Isen
*Attorney, Agent, or Firm*—Kontler, Grimes & Battersby

[57] ABSTRACT

An electronic piano includes a tone generator having a pulse generator and a discrete TOS circuit for each octave. The input of the first TOS circuit is connected with the pulse generator and the input of each next-following TOS circuit is connected with the input of the preceding TOS circuit by a divide-by-two divider circuit. The outputs of each TOS circuit are connected with discrete control circuits each having an analog switch for each output of the respective TOS circuit. First inputs of the analog switches receive envelope control voltage signals on depression of the respective piano keys while second inputs of the analog switches receive tone signals from the corresponding outputs of the respective TOS circuits. The outputs of the analog switches transmit tone signals, which are modulated as a function of the intensity the corresponding envelope control voltage signals, to a loudspeaker by way of either one of two main branches of the respective control circuits. The intensity of the envelope control voltage signals depends on the lengths of the intervals during which the corresponding keys move from undepressed to depressed positions. Key contact transients are eliminated from the modulated tone signals by superimposing thereon inverted d-c voltage signals whose amplitude is half the amplitude of the modulated tone signals. The dynamic volume range of the modulated tone signals is close to the range of tone volumes in a mechanical piano.

19 Claims, 10 Drawing Figures

Fig. 3
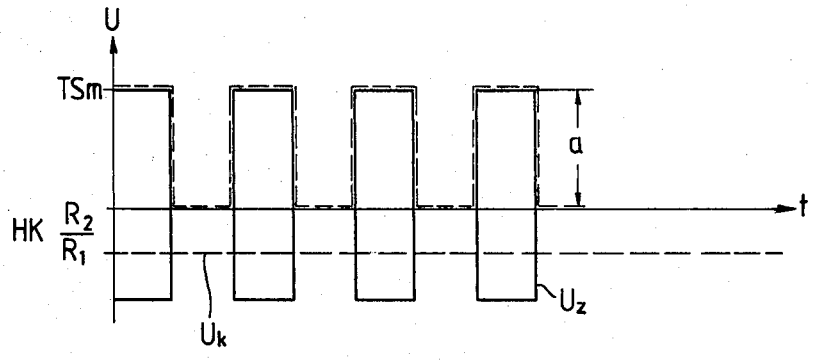
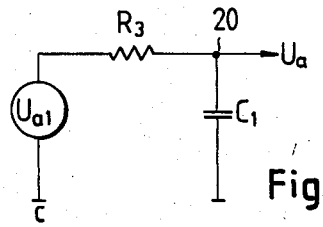
Fig. 4
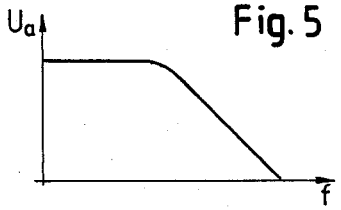
Fig. 5
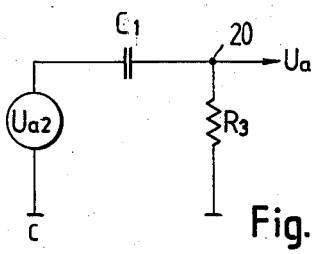
Fig. 6
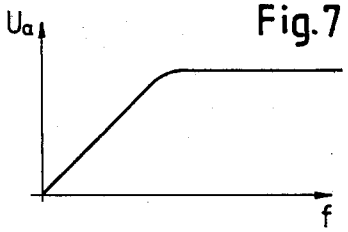
Fig. 7
Fig. 8
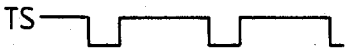

ELECTRICAL MUSICAL INSTRUMENT

BACKGROUND OF THE INVENTION

The present invention relates to electronic musical instruments in general, and more particularly to improvements in circuits which generate and process tone signals in electronic pianos, electronic organs and like key-operated electronic musical instruments. Still more particularly, the invention relates to improvements in electronic musical instruments of the type wherein the volume of the tone is dependent on the magnitude of force with which the player strikes the keys of the keyboard or keyboards and wherein switching elements modulate the amplitude of tone signals in dependency on the characteristics of envelope voltage control signals which are generated in response to depression of keys.

In a known circuit of the above outlined character (such circuit is used in the so-called Effekt-Piano manufactured and sold since 1974 by the West German firm WERSI), the switching elements are gate circuits in the form of diodes. Owing to the threshold voltage of a diode, the envelope control voltage must exceed a value of 0.5–0.7 volt before the tone signal is transmitted to the signal processing stage or stages of the musical instrument. The same applies when the gate circuit is a conventional transistor because the base-emitter circuit of the transistor also exhibits such a threshold voltage. In view of the fact that the amplitude of tone signals in an electronic musical instrument is limited to approximately 10 volts, a linear relationship between the envelope control voltage and the modulated tone signal exists only to a minimum value of approximately 1 volt. This corresponds to a dynamic volume range of 10:1 or 20 decibels. However, the dynamic volume range of a mechanical piano or a concert piano is much wider, namely, between 40 and 60 decibels, which corresponds to volume differences of 100:1 to 1000:1.

OBJECTS AND SUMMARY OF THE INVENTION

An object of the invention is to provide a novel and improved tone generating and tone processing circuit for use in electronic musical instruments, such as electronic pianos or electronic organs.

Another object of the invention is to provide a circuit which is capable of greatly expanding the dynamic volume range of an electronic musical instrument so that it comes much closer to that of a mechanical piano or concert piano.

A further object of the invention is to provide a novel and improved circuit which can modify tone signals in dependency on envelope control voltage signals.

An additional object of the invention is to provide a control circuit which can be installed in certain existing electronic musical instruments as a superior substitute for heretofore known circuits.

Another object of the invention is to provide a control circuit which can expand the dynamic volume range of an electronic piano or the like to a multiple of the range of heretofore known electronic organs of such character.

The invention is embodied in an electronic musical instrument which comprises first generator means (e.g., a pulse generator which furnishes a sequence of pulses and several so-called TOS circuits, one for each octave) for supplying tone signals, key means which is actuable to generate second signals of variable duration (depending on the length of the interval elapsing between the movement of the key means from the non-depressed position to the depressed position), second generator means for supplying envelope control signals whose intensity is a function of the duration of second signals, and control means for modulating the amplitude of tone signals as a function of characteristics of the corresponding envelope control signals. The control means includes an analog switch means or switch having a first input for the envelope control signals, a second input for tone signals and an output for modulated tone signals.

In accordance with a presently preferred embodiment of the control means, the analog switch includes a field effect transistor having a source constituting the first input, a gate constituting the second input and a drain which is the output of the analog switch.

The control means further comprises terminal means connected with the output of the analog switch and the control means may also comprise a bypass branch between the second generator means and the terminal means. The bypass branch comprises means for superimposing fourth signals upon the modulated tone signals. The magnitude of such fourth signals is preferably half the magnitude of the modulated signals. The branch bypasses the analog switch and its superimposing means may include an amplifier which constitutes an inverter with a reduction of the amplification factor.

The control means may further include a first main branch including an amplifier whose output is connected with the terminal means and which has an inverting input connected with the output of the inverter in the bypass branch, e.g., by way of a resistor.

Still further, the control means may comprise a second main branch which connects the terminal means with the output of the analog switch. The second main branch comprises means for transmitting modulated signals from the output of the analog switch to the terminal means when the amplitude of the modulated tone signals exceeds a predetermined value. Such signal transmitting means may include a high-pass filter (the first main branch then comprises a low-pass filter) or a Zener diode.

The second main branch may further comprise an amplifier the first input of which is connected with the output of the analog switch by a diode, the second input of which is connected with a source of constant bias potential and the output of which is connected to the aforementioned terminal means, e.g., by way of a capacitor if the connection between the output of a similar amplifier in the first main branch and the terminal means includes a resistor. The aforementioned terminal means is then disposed between the resistor and the capacitor.

The novel features which are considered as characteristic of the invention are set forth in particular in the appended claims. The improved electronic musical instrument itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 3 is a diagram showing variations of modulated tone signals in the circuit of FIG. 2 as a function of time;

FIG. 4 is a block diagram of a portion of a first main branch in the circuit of FIG. 2;

FIG. 5 is a diagram showing the variations of modulated voltage signals in the first main branch as a function of frequency changes;

FIG. 6 is a block diagram of a portion of a second main branch in the circuit of FIG. 2;

FIG. 7 is a diagram showing the variations of modulated voltage signals in the second main branch as a function of frequency changes;

FIG. 8 illustrates the shape of one of several tone signals which are supplied by the first generator means of the piano shown in FIG. 1;

DESCRIPTION OF THE PREFERRED EMBODIMENTS

Figure 1:
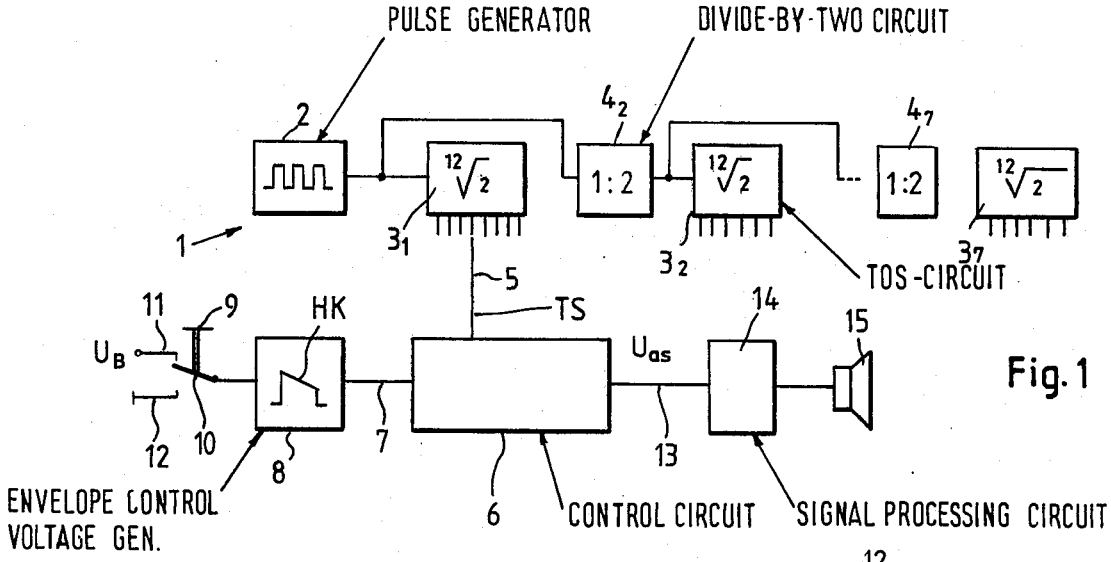
FIG. 1 is a block diagram of an electronic piano which embodies one form of the invention.

In the structure of FIG. 1 which forms part of an electronic piano, the tone generator 1 comprises a pulse generator 2 and seven top-octave-synthesizers $3_1$, $3_2$, $3_3$, . . . $3_7$ (hereinafter called TOS circuits), one for each of the seven octaves. The input of the TOS circuit $3_1$ for the first octave is connected directly with the output of the pulse generator 2, the input of the TOS circuit $3_2$ of the second octave is connected with the output of the pulse generator 2 by way of a first 1:2 (divide-by-two) divider circuit $4_2$, and so forth, i.e., the input of the TOS circuit $3_7$ for the last (seventh) octave is connected with the output of the pulse generator 2 by way of a 1:2 divider circuit $4_7$ and all preceding divide-by-two divider circuits. By way of example, the input of the TOS circuit $3_3$ (not shown in FIG. 1) is connected with the output of the pulse generator 2 by way of a divider circuit $4_3$ (not shown in FIG. 1) and the preceding divider circuit $4_2$. Otherwise stated, the input of each next-following TOS circuit (such as $3_7$) is connected with the input of the preceding TOS circuit ($3_6$) by a 1:2 divider circuit ($4_7$).

The tone signals TS which are supplied by the twelve outputs 5 of the first TOS circuit $3_1$ are transmitted to a first control circuit 6, the tone signals which are supplied by the outputs of the second TOS circuit $3_2$ are transmitted to a similar second control circuit (not shown), and so forth, i.e., a discrete control circuit is provided for each of the seven TOS circuits $3_1$ to $3_7$.

Figure 2:
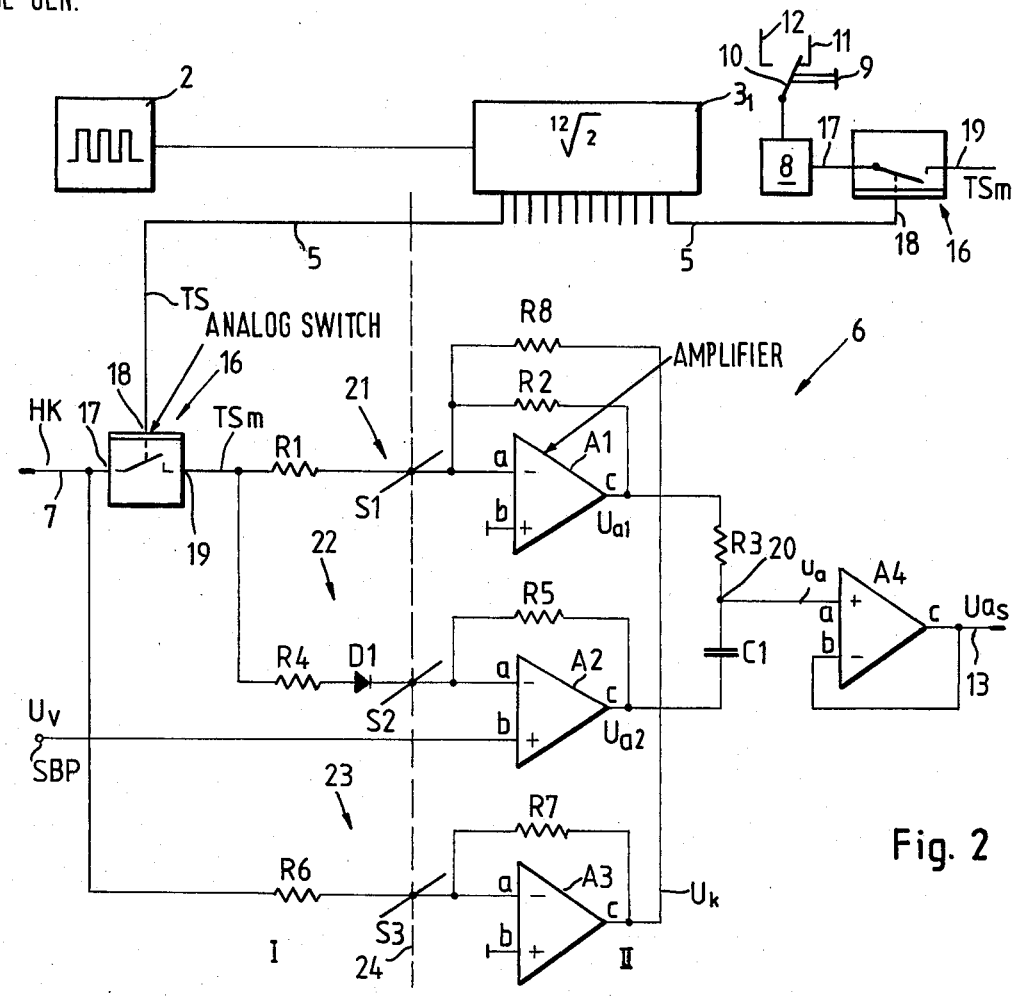
FIG. 2 is a diagrammatic view of one of several control circuits which can be utilized in the electronic piano of FIG. 1.

One of the control circuits 6 is illustrated in FIG. 2. This circuit receives tone signals TS from the outputs 5 of the respective TOS circuit $3_1$ and further receives an envelope control voltage signal HK from the output 7 of an envelope control voltage generator 8. The generator 8 transmits a signal HK in response to depression of a key 9 in the respective octave on the keyboard (not shown) of the electronic piano. Depression of the key 9 entails movement of a switch contact 10 from engagement with a first stationary contact 11 which supplies starting voltage or "at rest" voltage $U_B$ toward engagement with a second stationary contact 12 which is connected to ground. When the key 9 of FIG. 1 is held in the illustrated (non-depressed) position, a capacitor in the generator 8 is charged and such capacitor discharges during the interval of movement of the movable contact 10 from engagement with the stationary contact 11 toward engagement with the stationary contact 12. The contacts 11 and 12 are preferably bars so that they may be common to all keys 9 of the respective octave. A second key is shown in the upper right-hand portion of FIG. 2. The residual voltage in the capacitor of the generator 8 on engagement of the contact 10 with the contact 12 determines the amplitude of the envelope control voltage signal HK. If the player of the musical instrument decides to abruptly move a given key 9 to the depressed position, i.e., if the interval which elapses during movement of the switch contact 10 from engagement with the stationary contact 11 into engagement with the stationary contact 12 is relatively short, the residual voltage is greater and the amplitude of the signal HK (and the volume of the respective tone) is greater. The control circuit 6 includes means for modulating the tone signal TS in dependency on the characteristics of the envelope control voltage signal HK, and the resulting output signal or modulated tone signal $U_{as}$ is transmitted to the further processing unit 14 by way of conductor means 13. The processing unit 14 processes the signal $U_{as}$ and transmits the processed signal to a loudspeaker 15. The unit 14 comprises one or more output amplifiers for the tone signal which is to be transmitted to the loudspeaker 15.

The control circuit 6 which is associated with the TOS circuit $3_1$ for the first octave and is illustrated in FIG. 2 comprises a discrete analog switch 16 for each output 5 of the TOS $3_1$, and each such analog switch preferably constitutes a field effect transistor having a source (input) 17 connected with the output 7 of the generator 8, a gate (input) 18 which is connected to the respective output 5, and a drain (output) 19 which transmits the modulated tone signal TSm. The output or drain 19 is connected with the inverting input a of an operational amplifier A1 by way of a resistor R1. The inverting input a is further connected with the output c of the amplifier A1 by a feedback resistor R2. The non-inverting input b of the amplifier A1 is grounded. The output c of the amplifier A1 is further connected with an output terminal 20 by way of a resistor R3. The parts R1, A1, R2 and R3 constitute a main branch 21 of the control circuit 6 for the TOS circuit $3_1$.

A second main branch 22 of the control circuit 6 comprises the series connection of a resistor R4, a diode D1, an operational amplifier A2 having an inverting input a connected with the diode D1, a non-inverting input b connected with a source SBP of constant bias potential $U_v$ and an output c connected with the input a by a feedback resistor R5. The output c of the amplifier A2 is further connected with the terminal 20 by way of a capacitor C1.

A third or auxiliary branch 23 of the control circuit 6 comprises a resistor R6 and a third operational amplifier A3 which constitutes an inverter and whose output c is connected with the inverting input a by a feedback resistor R7. The second (non-inverting) input b of the third amplifier A3 is connected to ground. The output c of the amplifier A3 is further connected with the inverting input a of the amplifier A1 by a resistor R8.

The terminal 20 is connected with the conductor 13 (input of the tone processing unit 14 shown in FIG. 1)

by a fourth operational amplifier A4 having a non-inverting input a and an inverting input b. The output c of the amplifier A4 transmits the tone signal $U_{as}$.

The vertical broken line 24 separates in FIG. 2 a left-hand portion I of the control circuit 6 from a right-hand portion II. The parts shown in the portion I are provided for each and every output 5 of the corresponding TOS circuit $3_1$ whereas the parts in the portion II are provided only once. Thus, there are a total of twelve field effect transistors 16, a total of twelve diodes D1, etc. but only one amplifier A1, only one amplifier A2, etc. All constituents of a full octave can be installed on a common plug-in board or circuit board of the type disclosed in the commonly owned copending application Ser. No. 235,620 filed Feb. 19, 1981 by Reinhard Franz for "Frame for removable components of electronic musical instruments".

The reference character S1 denotes in FIG. 2 a bus bar which connects the input a of the amplifier A1 with the twelve resistors R1 of the portion I. A bus bar S2 connects the input a of the amplifier A2 with the twelve diodes D1 of the portion I, and a bus bar S3 connects the input a of the amplifier A3 with the twelve resistors R6 in the portion I. The bus bars S1, S2 and S3 contribute to simplification of the electronic musical instrument and reduce its cost by reducing the number of discrete components, especially the number of amplifiers. Thus, the amplifiers A1, A2 and A3 suffice for all twelve analog switches 16 which are needed in connection with the corresponding TOS circuit $3_1$. There are twelve analog switches 16 for each of the TOS circuits. The TOS circuits can be placed into close or immediate proximity of the corresponding sets of twelve analog switches to ensure that the lengths of the paths for the transmission of tone signals TS via outputs 5 is held to a minimum. This renders it possible to mount all components which are associated with a given TOS circuit on a common plug-in board of the type described in the aforementioned commonly owned copending application Ser. No. 235,620 filed Feb. 19, 1981 by Reinhard Franz for "Frame for removable components of electronic musical instruments". The utilization of divide-by-two divider circuits $4_1 \ldots 4_7$ also contributes to simplification of the circuitry, i.e., there is no need to provide a host of conductors to connect the individual octaves with each other.

TOS circuits with a pulse on-off ratio of 25–30 percent are especially desirable. Such circuits are available on the market and, therefore, it is not necessary to resort to the more cumbersome technique of achieving the 25 percent ratio (which is particularly desirable in a piano) by combining the signals of two octaves in accordance with heretofore known techniques.

The operation of the control circuit 6 of FIG. 2 is as follows:

FIG. 3 is a diagram wherein the time t is measured along the abscissa and the voltage U is measured along the ordinate. The amplitude a of the modulated tone signal TSm corresponds to that of the envelope control voltage HK which is applied by the analog switch 16 in dependency on the tone signal TS. If the tone signal TS were processed exclusively by the amplifier A1 in the first main branch 21 of the control circuit 6, the voltage $U_z$ at the output c of the amplifier A1 (and hence at the output 13 of the circuit 6) would correspond to that shown in FIG. 3 and would equal $-HK \times (R2/R1)$. The average d-c value of this voltage is such that it entails the development of a key contact transient in response to depression of any one of the twelve keys 9 in the octave including the control circuit 6 of FIG. 2. In order to eliminate or prevent the development of such key contact transient, the auxiliary branch 23 of the circuit 6 supplies a compensating voltage $U_k$ which is superimposed upon the tone signals TSm and eliminates the d-c component and hence the key contact transient.

As best seen in FIG. 4, the resistor R3 and the capacitor C1 in the main branches 21 and 22 constitute a low-pass filter for the voltage $U_{a1}$ at the output c of the amplifier A1. This filter causes the voltage $U_a$ at the terminal 20 to vary as a function of frequency f in a manner as illustrated in the diagram of FIG. 5.

The resistor R3 and the capacitor C1 further constitute a high-pass filter (see FIG. 6) for the voltage $U_{a2}$ at the output c of the amplifier A2 in the second main branch 22 of the control circuit 6 of FIG. 2. This filter causes the voltage $U_a$ to vary as a function of frequency f in a manner as illustrated in the diagram of FIG. 7. Since the input b of the amplifier A2 is connected with the source SBP of constant bias potential $U_v$ (e.g., 5 volts), and the threshold voltage of the diode D1 is also fixed (e.g., 0.5 volt), the second main branch 22 of the control circuit 6 is effective only when the envelope control voltage HK exceeds the sum of the aforementioned fixed voltages, i.e., when HK exceeds 5.5 volts. Thus, if the player strikes a selected key 9 with a greater force, the effect of the high-pass filter C1, R3 in the second main branch 22 is more pronounced and the influence of overtones is also increased proportionately to the increasing force with which the selected key is depressed.

FIG. 8 shows that each of the TOS circuit $3_1$ to $3_7$ transmits tone signals TS having a pulse on-off ratio of approximately 70:30. This leads to an overtone or upper harmonic spectrum which is highly satisfactory for an electronic piano.

An important advantage of the improved control circuit is that the analog switch 16 conveys the amplitude of the available envelope control voltage in the desired tone frequency to its output 19 with assistance from the tone signal TS. Since the maximum value of the envelope control voltage can match the operating voltage (normally in the range of 15 volts) of the musical instrument, and since the analog switch 16 is capable of switching through envelope control voltage signals whose value is as low as zero, the dynamic volume range of the musical instrument which embodies the circuitry of FIG. 2 is surprisingly wide. In fact, such range is limited solely by the offset of the operational amplifier which receives signals from the analog switch. As a rule, such offset is approximately 1.5 mv. If this is compared with the operating voltage of 15 volts, one obtains a working range of approximately 10000:1 or 80 decibels.

The aforementioned field effect transistor constitutes a presently preferred analog switch for use in the control circuit of the invention.

The magnitude of the signals $U_k$ which are superimposed by the branch 23 equals half the magnitude of the tone signal TSm at the locus where the signal $U_k$ is superimposed upon the signal TSm. The inverted d-c signal $U_k$ suppresses the aforediscussed key contact transient. The value of the signal $U_k$ is deducted from the value of the signal which the input a of the amplifier A1 in the first main branch 21 receives via resistor R1.

When a key in a mechanical piano is struck with a considerable force, this results in short-lasting pronounced accentuation of the upper harmonic waves in comparison with the fundamental wave. The improved electronic musical instrument can imitate such effect due to the provision of the second main branch 22 which acts as a high-pass filter and which transmits signals when the amplitude of the modulated tone signals at the output 19 of the analog switch 16 exceeds a preselected value. In this manner, rapid depression of the keys 9 entails the transfer of upper harmonic waves to the terminal 20 and thence to the loudspeaker 15. Since the first main branch 21 constitutes a low-pass filter, the percentage of lower frequencies predominates in response to relatively slow movements of the keys 9 from engagement with the contact 11 into engagement with the contact 12.

Figure 9:
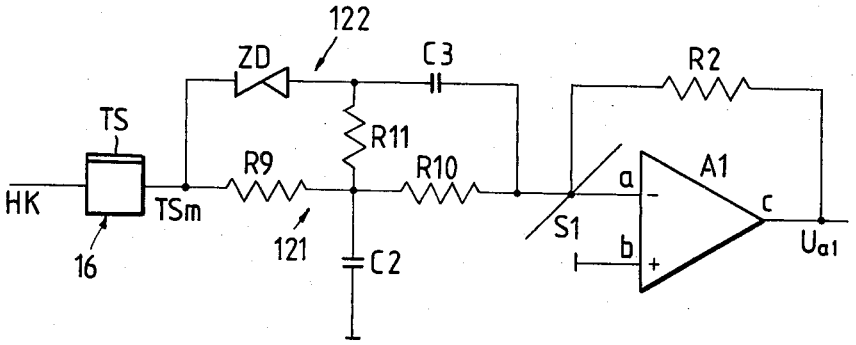
FIG. 9 illustrates a portion of a second control circuit with modified first and second main branches.

FIG. 9 illustrates a portion of a modified control circuit wherein the main branch 121 comprises a series-connected resistor R9, a parallel-connected capacitor C2 and a second series-connected resistor R10. The second main branch 122 comprises a Zener diode ZD, a parallel-connected resistor R11 and a series-connected capacitor C3. The main branches 121 and 122 are connected in parallel and are connected to the input a of the operational amplifier A1. In this embodiment of the control circuit, the main branch 121 constitutes a low-pass filter whereas the high-pass filtering effect of the branch 122 is felt only when the blocking voltage of the Zener diode ZD is exceeded.

The diode ZD ensures that the second main branch 122 transmits signals TSm only when a predetermined lower limit of amplitudes is exceeded. This diode replaces the corresponding arrangement of FIG. 2 wherein the second main branch 22 contains an amplifier (A2) one input (b) of which is connected with a source (SBP) of constant bias voltage ($U_v$) and the other input of which receives modulated tone signals TSm via diode D1.

Figure 10:
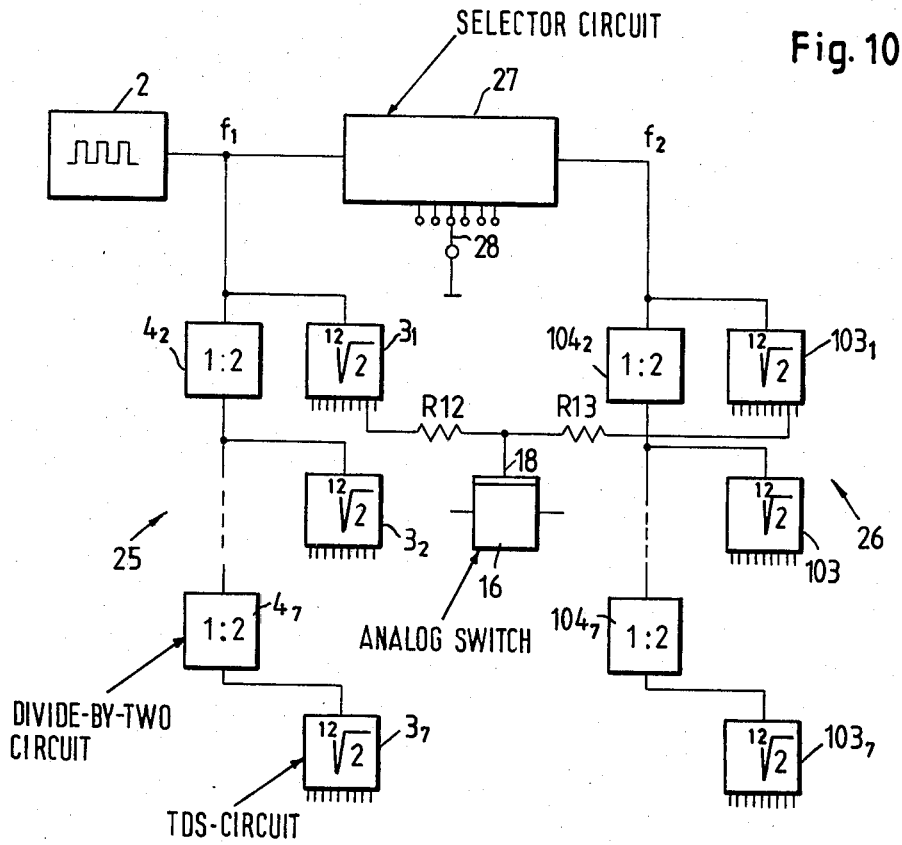
FIG. 10 is a block diagram of a further electronic musical instrument.

FIG. 10 shows a tone generator arrangement which comprises a first group 25 of TOS circuits $3_1$, $3_2 \ldots 3_7$ corresponding to those shown in FIG. 1 and cooperating with 1:2 divider circuits $4_1 \ldots 4_7$. The arrangement further comprises a second group 26 of TOS circuits $103_1$, $103_2 \ldots 103_7$ with corresponding 1:2 divider circuits $104_2 \ldots 104_7$ which are connected with the pulse generator 2 by a pulse eliminating selector circuit 27 of the type disclosed in commonly owned copending application Ser. No. 226,694 filed Jan. 21, 1981 by Reinhard Franz et al. for "Tone generator system for electronic musical instrument". The selector circuit 27 cooperates with a system of programming switches 28 each of which can change the number of pulses which are suppressed by the circuit 27 instead of being transmitted to the TOS circuit $103_1$ and to the divider circuit $104_2$ of the second group 26. For example, if the frequency $f_1$ of the pulse generator 2 is 2 MHz, the frequency $f_2$ at the output of the selector circuit 27 may equal 1.9998 MHz, i.e., the selector circuit 27 then suppresses each fiftieth pulse. This amounts to a relatively small shift of the pulse frequencies of TOS circuits $103_1 \ldots 103_7$ in the group 26 relative to those of the TOS circuits $3_1 \ldots 3_7$ in the group 25. The result is a certain amount of interference or beating of the tone which is especially interesting if the electronic musical instrument embodying the structure of FIG. 10 is to generate tones in imitation of a piano wherein the generation of tones takes place by resorting to two or more strings which are slightly out of tune.

The tone signals which are transmitted by two corresponding TOS circuits, e.g., the circuits $3_1$ and $103_1$, are applied to the input 18 of a common analog switch 16 by way of resistors R12 and R13 so that the switch 16 simultaneously transmits tone signals from the circuits $3_1$ and $103_1$. The same applies for the other analog switches 16 (not shown in FIG. 10). The circuit of FIG. 10 comprises twelve analog switches 16 for each of the fourteen TOS circuits $3_1 \ldots 37$ and $103_1 \ldots 103_7$. The associated generators 8 and keys 9 (their number equals the number of switches 16) have been omitted in FIG. 10 for the sake of clarity.

The electronic musical instrument which embodies the structure of FIG. 10 exhibits a number of important advantages. Thus, a single pulse generator (2) suffices for both groups of TOS circuits $3_1 \ldots 3_7$ and $103_1 \ldots 103_7$. Moreover, and since the circuit 27 suppresses a relatively small number of pulses of the pulse series supplied by the output of the pulse generator 2, the tone signals which an analog switch 16 receives from one of the circuits $3_1 \ldots 3_7$ in the group 25 are very similar to tone signals supplied thereto by the corresponding TOS circuit of the group 26. As mentioned above, this ensures that the tones imitate those of a piano wherein the generation of tones takes place by resorting to two or more strings which are slightly out of tune.

An experiment with the improved electronic musical instrument was performed with the voltage $U_B=15$ volts. The square signal voltage of the tone signals TS was 10 volts and the selected bias voltage $U_v$ was 5 volts. This furnished a dynamic volume range of 60–80 decibels. The compensating voltage $U_K$ can readily conform to the value of the modulated tone signal TSm by appropriate selection of the resistors R6, R7 and R8.

The components of the improved electronic circuit are available on the market. For example, one can utilize the following integrated circuits: Each operational amplifier may be a circuit of the type known as TL 074 manufactured by Texas Instruments, each TOS circuit may be of the type known as MO 82 manufactured by SGS-ATES (Italy or UK), and each analog switch may be of the type known as 4016 manufactured by National Semiconductor.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In an electronic musical instrument, the combination of first generator means for supplying tone signals; key means actuable to generate additional signals of variable duration; second generator means for supplying envelope control signals whose intensity is a function of the duration of the additional signals; and control means for modulating the amplitude of the tone signals as a function of the characteristics of the envelope control signals, said control means including terminal means, and analog switch means having a first input for the envelope control signals, a second input for the tone signals and an output for modulated tone signals connected with said terminal means, said control means further including a bypass branch between said second generator means and said terminal means bypassing said analog switch means, and said bypass branch comprising means for superimposing upon the modulated tone signals further signals whose magnitude is half that of the modulated tone signals, said superimposing means including an amplifier which constitutes an inverter and is operative to reduce the magnitudes of signals supplied thereto.

2. In an electronic musical instrument, the combination of first generator means for supplying tone signals; key means actuable to generate additional signals of variable duration; second generatore means for supplying envelope control signals whose intensity is a function of the duration of the additional signals; and control means for modulating the amplitude of the tone signals as a function of the characteristics of the envelope control signals, said control means including terminal means, and analog switch means having a first input for the envelope control signals, a second input for the tone signals and an output for modulated tone signals connected with said terminal means, said control means further including a main branch which comprises an amplifier having an inverting input connected with said output, and said control means also including a bypass branch between said second generator means and said terminal means connected with said inverting input, said bypass branch comprising means for superimposing upon the modulated tone signals further signals whose magnitude is half that of the modulated tone signals.

3. In an electronic musical instrument, the combination of first generator means for supplying tone signals; key means actuable to generate additional signals of variable duration; second generator means for supplying envelope control signals whose intensity is a function of the duration of the additional signals; and control means for modulating the amplitude of the tone signals as a function of the characteristics of the envelope control signals, said control means including analog switch means having a first input for the envelope control signals, a second input for the tone signals and an output for modulated tone signals, and said control means further including a terminal, and a first main branch connecting said output with said terminal to transmit modulated tone signals to said terminal, said control means also including a second main branch connecting said output with said terminal, and said second main branch comprising means for transmitting modulated signals from said output to said terminal when the amplitude of the modulated tone signals exceeds a predetermined value, said transmitting means including a high-pass filter.

4. The combination of claim 3, wherein said analog switch means comprises a field effect transistor having a source which constitutes said first input and a gate constituting said second input.

5. The combination of claim 3, said control means further comprising a bypass branch between said second generator means and said terminal, and said bypass branch comprising means for superimposing upon the modulated tone signals further signals whose amplitude is half the amplitude of the modulated tone signals.

6. The combination of claim 3, wherein said first main branch includes a low-pass filter.

7. The combination of claim 3, wherein said first generator means comprises a 12-tone synthesizer having a pulse on-off ratio of approximately 25 to 30%.

8. The combination of claim 3, wherein said first generator means includes first and second TOS circuits having outputs connected with said second input of said analog switch means; and further comprising selector means for changing the frequency of tone signals furnished by said second TOS circuit relative to the frequency of tone signals furnished by said first TOS circuit.

9. The combination of claim 8, wherein said first generator means further comprises a pulse generator arranged to transmit a series of pulses and directly connected with said first TOS circuit, said pulse generator being connected with said second TOS circuit by way of said selector means and said selector means comprising means for suppressing selected pulses of the series of pulses transmitted by said pulse generator.

10. The combination of claim 9, wherein the number of pulses suppressed by said selector means is such that the characteristics of tone signals supplied by said second TOS circuit closely resemble the characteristics of tone signals furnished by said first TOS circuit.

11. In an electronic musical instrument, the combination of first generator means for supplying tone signals; a plurality of key means actuable to generate additional signals of variable duration; a second generator means for each of said key means operative to supply envelope control signals whose intensity is a function of the duration of the additional signals; and control means for modulating the amplitudes of the tone signals as a function of the characteristics of the envelope control signals, said control means including an analog switch means for each of said second generator means having a first input for the envelope control signals, a second input for the tone signals and an output for modulated tone signals, and said control means also including first and second main branches and a bypass branch, each of said branches comprising a discrete amplifier having an input, and said control means further including first and second bus bars connecting said inputs of said amplifiers in said main branches with all of said outputs of said analog switch means, said control means additionally including a third bus bar connecting said input of said amplifier in said bypass branch with all of said second generator means.

12. The combination of claim 11, wherein said control means further includes a terminal, a first main branch connecting said outputs with said terminal to transmit modulated tone signals thereto, and said second main branch connecting said outputs with said terminal, said second main branch including means for transmitting modulated signals to said terminal when the amplitude of modulated tone signals exceeds a predetermined value.

13. The combination of claim 12, wherein said means for transmitting modulated tone signals includes a Zener diode.

14. The combination of claim 11, wherein the number of said analog switches equals the number of key means in an octave and said first generator means comprises a TOS circuit having an input and a plurality of outputs, one for each of said analog switches and each connected with the second input of the respective analog switch.

15. The combination of claim 14, wherein said first generator means further comprises a second TOS circuit having an input and twelve outputs, a divider circuit connecting the input of said first mentioned TOS circuit with the input of said second TOS circuit, further key means, one for each output of said second TOS circuit, further analog switches, one for each of said further key means, further second generator means, one for each of said further analog switches, and second control means corresponding to said first mentioned control means and having first and second main branches connected with the outputs of said further analog switches and a bypass branch connected with the further second generator means.

16. The combination of claim 15, wherein each of said TOS circuits has a pulse on-off ratio of 25–30 percent.

17. In an electronic musical instrument, the combination of first generator means for supplying tone signals; key means actuable to generate additional signals of variable duration; second generator means for supplying envelope control signals whose intensity is a function of the duration of the additional signals; control means for modulating the amplitude of the tone signals as a function of the characteristics of the envelope control signals, said control means including analog switch means having a first input for the envelope control signals, a second input for the tone signals and an output for modulated tone signals, and said control means further including a terminal, and a first main branch connecting said output with said terminal to transmit modulated tone signals to said terminal, said control means also including a second main branch connecting said output with said terminal, and said second main branch comprising means for transmitting modulated signals from said output to said terminal when the amplitude of the modulated tone signals exceeds a predetermined value, said second main branch further comprising an amplifier having first and second inputs and an output, and a diode connecting said first input of said amplifier with said output of said analog switch means, said output of said amplifier being connected to said terminal; and a source of constant bias potential connected to said second input of said amplifier.

18. In an electronic musical instrument, the combination of first generator means for supplying tone signals, key means actuable to generate additional signals of variable duration; second generator means for supplying envelope control signals whose intensity is a function of the duration of the additional signals; and control means for modulating the amplitude of the tone signals as a function of the characteristics of the envelope control signals, said control means including analog switch means having a first input for the envelope control signals, a second input for the tone signals and an output for modulated tone signals, and said control means further including a terminal, and a first main branch connecting said output with said terminal to transmit modulated tone signals to said terminal, said first main branch comprising a first amplifier having an output, and an input connected with said output of said analog switch means, and said first main branch also comprising resistor means connected between said terminal and said output of said amplifier, said control means additionally including a second main branch connecting said output of said analog switch means with said terminal, and said second main branch comprising a second amplifier having an output, and an input connected with said output of said analog switch means, said second main branch further comprising means for transmitting modulated signals from said output of said analog switch means to said terminal when the amplitude of the modulated tone signals exceeds a predetermined value, and said transmitting means including capacitor means connected between said terminal and said output of said second amplifier.

19. The combination of claim 18, wherein said terminal is connected between said resistor means and said capacitor means.

* * * * *